United States Patent [19]

Fandrey et al.

[11] 4,256,436

[45] Mar. 17, 1981

[54] SELF-PRIMING PUMP

[75] Inventors: Peter Fandrey, Glückstad; Hermann Müller, Oldendorf, both of Fed. Rep. of Germany

[73] Assignee: SIHI GmbH & Co. KG, Fed. Rep. of Germany

[21] Appl. No.: 972,357

[22] Filed: Dec. 22, 1978

[30] Foreign Application Priority Data

Dec. 24, 1977 [DD] German Democratic Rep. ..... 2757952

[51] Int. Cl.[3] ..... F01D 13/02

[52] U.S. Cl. ..... 415/143; 415/168; 415/175

[58] Field of Search ..... 415/143, 168, 175

[56] References Cited

U.S. PATENT DOCUMENTS

| | | | |
|---|---|---|---|
| 2,758,815 | 8/1956 | Fontaine et al. | 415/168 |
| 2,777,395 | 1/1957 | Disbrow | 415/175 |
| 2,780,999 | 2/1957 | Compton et al. | 415/168 |
| 2,949,321 | 8/1960 | Tracy | 415/175 |
| 3,174,719 | 3/1965 | Sproule et al. | 415/168 |
| 3,203,354 | 8/1965 | Pedersen | 415/168 |
| 3,230,890 | 1/1966 | Yokota et al. | 415/168 |
| 3,457,871 | 7/1969 | Herger | 415/143 |

*Primary Examiner*—Robert E. Garrett

*Attorney, Agent, or Firm*—Prutzman, Kalb, Chilton & Alix

[57] ABSTRACT

The invention relates to a self-priming centrifugal pump that consists of at least one fully-loaded pump or turbine stage with a horizontal shaft and one priming or ventilator stage that is fixed to the same shaft outside the main delivery stream, in the form of a lateral channel or liquid ring pump. In certain specific applications there is no flow through the ventilator stage during normal operation of the pump, and for this reason the ventilator stage is not cooled. The ventilator stage is cooled by virtue of the fact that the suction side of this stage is not only connected to the suction area of the fully loaded turbine stage, in which the gases that are to be removed usually collect, but is also connected to the pressure side of the pump, so that during normal operation a stream of liquid that has a cooling action is formed, and this passes by the suction opening of the ventilator stage.

8 Claims, 1 Drawing Figure

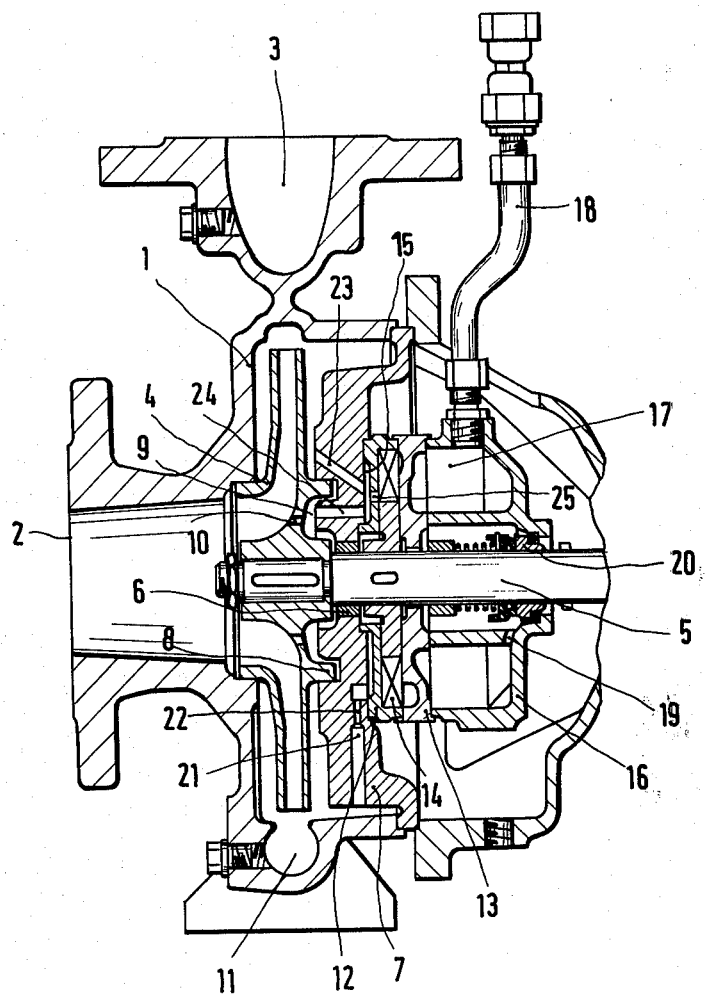
3
18
15
1
23
4
24
17
9
25
2
10
20
6
5
8
19
22
16
21
14
13
11
12
7

SELF-PRIMING PUMP

The invention relates to a self-priming centrifugal pump with at least one fully loaded pump or turbine stage with a horizontal shaft and a priming or ventilator stage that is fixed to the same shaft outside the main delivery stream, in the form of a lateral channel or a liquid ring pump, the delivery of which can be shut off during normal operation of the pump, and the suction side of which is connected through a constantly open discharge port to a first, suction side area of the fully loaded stage, in which gas which is to be removed collects.

In known pumps, the priming or ventilator stage is so arranged that even during normal operation of the pump, when no gas delivery is necessary, liquid flows through it. In some pumps, the flow of liquid through the ventilator stage, that discharges to the atmosphere, is shut off on its pressure (delivery) side by a float valve as soon as the delivery of gas is finished. In other familiar pumps the flow path through the ventilator stage that discharges into the pressure connector of the pump is closed by a non-return valve in the pressure side of the ventilator stage if there is a danger that the ventilator stage will be back-loaded during normal operation because of the great pressure head of the fully loaded turbine stage. In both cases delivery through the ventilator stage is necessarily shut off during normal operation, so that the power that is converted in the ventilator stage because of its constant motion results in an increase in temperature. When a temperature that is close to the boiling point of the liquid is reached, the ventilator stage becomes inoperative. The same result can occur, without any forced shut-off of the flow path of the ventilator pump, if the pressure head of the fully loaded stage coincides with the maximum pressure head of the ventilator stage. The delivery flow of the ventilator stage is then shut off by back pressure.

Thus this invention undertakes the task of providing adequate cooling for the ventilator stage, even if the delivery flow through the ventilator stage is shut off either fortuitously or of necessity during normal operation of the pump.

The solution according to this invention lies in the fact that the suction side of the ventilator stage is connected through a second port, that is constantly open, to a second area of the fully loaded pump or turbine stage which, during normal operation, is under a greater pressure than the first, whereby the dimensions of both ports are such that during normal operation a flow of liquid sufficient to cool the ventilator stage passes through them from the second stage of the fully loaded turbine stage to the suction side of the priming or ventilator stage and from there to the first stage of the fully loaded turbine stage.

Unlike ventilator stages that are situated in the main delivery stream of the pump, or are constantly involved in the delivery stream, in the case of this invention the cooling current does not flow through the ventilator stage itself. On the contrary, the cooling current flows past to the ventilator stage through the two ports, whereby it can remove heat from it.

A further difference from familiar pumps lies in the fact that during normal operation the cooling current flows in the reverse direction through the first port, which during the ventilation phase carries gas from the suction side of the fully loaded turbine stage to the suction side of the ventilator stage.

When several fully loaded turbine stages are available it is always the last stage which is meant when reference is made to the fully loaded tubine stage in the foregoing.

Extremely efficient cooling of the ventilator stage is achieved if the first and the second ports are connected to each other in the immediate vicinity of the suction port of the ventilator stage, so that the cooling current is directed past in the immediate vicinity of the suction port. This results in an intensive fluid exchange through the suction port of the ventilator stage. In addition to, or instead of, this, it can also be that the walls of the first and/or of the second port are arranged in close, thermally conductive connection with the ventilator stage. This means that even during normal operation the temperature of the ventilator stage remains at a suitably low level so that it remains constantly operable and can immediately function once again as a ventilator stage in the event of aeration occuring at the suction side of the pump.

It is expedient that a space that is axially adjacent to the rotor of the fully loaded turbine stage and connected to the pressure side of the fully loaded turbine stage is selected as the aforementioned second stage of the fully loaded turbine stage, from which the second port goes out to the suction side of the ventilator stage. However, it is not essential, even though it is expedient, that this space be at the full pressure of the pressure side of the turbine stage providing it is sufficiently high to produce the desired cooling current.

It is expedient that a chamber that is axially adjacent to the turbine rotor and connected to the suction side hub area of the rotor be selected as the aforementioned first area of the fully loaded turbine stage. This area is usually separated from the pressure side of the rotor by a sealing ring slot and is connected to the suction side hub area of the turbine rotor through equalizing bores. This selection of the so-called first and second areas of the fully loaded turbine stage entails the advantage of short ports to the ventilator stage because these are adjacent to the areas next to the fully loaded turbine rotor or impeller. This selection of the areas thereby permits a short and direct connection to the suction side of the pump, where gases which are to be removed collect, and to the pressure side of the fully loaded rotor. Finally, this selection of the aforementioned areas makes it possible to satisfy the demand that the ports discharge into areas that are at different pressures, so as to ensure the creation of a cooling current through the aforementioned ports during normal operation of the pump.

The invention is independent of whether or not the ventilator stage has a suction chamber that is large in comparison with the cross section of the ports before its suction port. If such a suction port is provided it is expedient that its axial extent be kept small, which is to say, not much greater than the half width of the impeller of the ventilator stage in order that, on the one hand, fluid that is drawn from the fully loaded pump area during the ventilating process enters the impeller cell quickly and as completely as possible, and, on the other hand, in order that during normal operation, i.e., during the delivery of liquid, the liquid that flows through the suction chamber passes as directly as possible to the suction side control plate of the ventilator stage. The suction chamber may exhibit a considerable extent in the radial direction for the purpose of large-area heat exchange.

It is expedient that the second port include a canal that extends from a geodetically deep area of the fully loaded turbine stage, in order that when the ventilating phase begins, the liquid remaining in the pump is passed to the ventilator stage as operating liquid. However, even in the ventilating phase itself, considerable pressure can occur at a geodetically deep point which accordingly is also at a considerable distance off the axis. In order that this does not lead to overfilling of the ventilator stage, to which the liquid is passed through the same port as the gas, it is frequently expedient to design the canal with a cross section that will restrict the passage of liquid to the ventilator stage. This will also restrict the strength of the cooling stream during normal operation of the pump. In addition, this can also lead to the fact that if the first port is wide the pressure at the suction opening of the ventilator stage may be very low during normal operation, and thereby promote cavitation. This disadvantage can be eliminated if the second port, in addition to the canal, also has an opening that discharges in the fully loaded turbine stage next to the runner and closer to the shaft than the canal, that is to say, in an area in which, because of greater proximity to the axis in the ventilating phase there is gas and not liquid. The passage of liquid to the ventilator stage will thereby be restricted, on the one hand, whereas on the other, during normal operation there will be an adequate flow of cooling liquid as well as an increase in pressure at the suction port of the ventilator stage.

The invention will be described in greater detail below, reference being made to the drawings which show a vertical cross section of the pump according to this invention.

The centrifugal pump housing 1 with the suction inlet 2 and the pressure connection 3 contains a fully loaded pump rotor 4, the hub of which is secured to the shaft 5, which in turn is held in the bearing 6 in the housing plate 7 that is rigidly connected to the housing. On the rear of the rotor there is a split ring 8 that engages in a groove in the housing plate 7 and with a groove wall forms a sealing ring slot. Within the split ring 8 between the rotor 4 and the housing plate 7 there is a space 9 which is connected through the equalizing bores 10 to the suction side area in the vicinity of the rotor hub, in which gas which is to be drawn off collects. Extending radially beyond the rotor 4 there is a spiral chamber 11 which discharges into the pressure connection 3 in a manner not shown in the drawing.

Located axially behind the housing plate 7 there is the housing for the priming or ventilator stage; this consists of a suction side control plate 12 and a pressure side control plate 13, and includes a ventilator impeller 14. On its periphery, the suction side control plate 12 is connected tightly to the housing plate 7 and with this forms an axially flat annular space 15, which forms the suction chamber of the ventilator stage. This is connected, in the familiar way, with the ventilator stage suction chamber through the suction opening 25.

The pressure side control plate with a housing component 16 forms the pressure chamber 17 of the ventilator stage, to which the line 18 is connected. This carries the gas either to the pressure connection 3 or into the pressure line of the pump connected thereto, in which regard it can embody a one-way valve that closes this line if, during the delivery of liquid the delivery head of the fully loaded rotor is greater than the delivery head of the ventilator stage, or it passes the gas to the atmosphere, in which case it is provided with a float valve that closes the line as soon as the ventilating phase is finished and the ventilator stage delivers liquid.

Liquid can be supplied from the pressure chamber 17 through a bore 19 to a slip-ring seal 20 for purposes of lubrication.

The suction chamber 15 is connected by the canal 21 to a deeply located area of the fully loaded pump stage close to the spiral chamber. It contains a restricted portion 22 to limit the operating liquid that is passed to the ventilator stage during the ventilating phase. In addition, the suction chamber 15 is connected through an opening 23 to the part of the space between the rotor 4 and the housing plate 7 that is beyond the split ring 8. In the suction phase, the liquid that is in the fully loaded pump is thrown to the outside, where if forms a liquid ring, whereas the central area of the pump is filled with gas. The opening 23 is then in an area in which there is gas for a considerable part of the suction phase so that in the suction phase the flow of operating liquid to the ventilator stage through the canal 21 is prevented. However, in normal operation, the area of the opening is also filled with liquid so that an additional cooling flow can also pass to the suction port of the ventilator stage. For this reason it is also expedient to arrange the opening 23 in the immediate promixity of the suction port. In addition, the opening 23, that is connected to the pressure side of the fully loaded turbine stage, has the effect that the pressure at the suction side of the ventilator stage is raised, thereby reducing the danger of cavitation.

Finally, the suction chamber 15 of the ventilator stage is connected to the chamber 9 through the port 24, so that gas that collects in the area of the hub of the rotor 4 can be drawn off through the equalizing bore 10, the chamber 9 and the port 24.

In the ventilating phase, liquid flows to the ventilator stage through the canal 21 as well as through the openings 23 and 24. During normal operation, cold liquid flows constantly through the canal 21 and the opening 23 into the suction chamber 15 of the ventilator stage, causes intensive cooling in this area, and escapes through the port 24. Cooling takes place as a result of liquid exchange through the suction slot of the pump and because of heat transfer through the suction side control plate 12.

The narrow pressure chamber 15 of the ventilator stage on the side of the suction port to which, during normal operation, the liquid flows to the suction port, can be considered part of the second port that is defined in the claims, whereas the part of the suction chamber in which, during normal operation, liquid flows from the suction port to the drilling 24 can be considered part of the first port that is defined in the claims. In this sense both ports merge in the immediate proximity of the suction port. In the drawing, the opening 23 and the port 24 are shown as being close to each other. It is to be understood, however, that they can be displaced along the periphery, in order to form a longer flow path for the cooling liquid in the suction chamber 15.

The embodiments of the invention in which an exclusive property or privilege is claimed are defined as follows:

1. A self-priming centrifugal pump comprising at least one fully loaded pump stage mounted on a shaft, a priming stage mounted rigidly on the same shaft in the manner of a side channel or liquid ring pump, the suction side of the priming stage being connected through a first, permanently open port with a first, suction side area of the fully loaded pump stage in which gas that is to be drawn off collects, the suction side of the priming stage being connected through a second, permanently open port with a second area of the fully loaded pump stage which, during normal operation, is at a higher pressure than the first area, whereby both the first and second ports are so designed that in normal operation a stream of liquid that is sufficient to cool the priming stage flows from the second area of the fully loaded pump stage to the suction side of the priming stage and from there to the first area of the fully loaded pump stage.

2. A centrifugal pump according to claim 1, wherein the first port and the second port are connected to each other in the immediate proximity of a suction port of the priming stage so that the cooling stream passes in the immediate proximity of the suction port.

3. A centrifugal pump according to claim 1, wherein the walls of at least one of the first and the second port are arranged in close thermally conductive connection with the priming stage.

4. A centrifugal pump according to any one of claims 1 to 3, wherein the aforementioned second area of the fully loaded pump stage is an area forming part of the pressure side thereof axially to one side of a rotor of the pump stage.

5. A centrifugal pump according to any one of the claims 1 to 3, wherein the aforementioned first area of the fully loaded pump stage is an area that is connected with the suction side hub area of a rotor of the pump stage and axially adjacent the rotor.

6. A centrifugal pump according to claim 2 wherein a suction chamber is arranged in front of the suction port of the priming stage, the axial extent of this suction chamber being small, that is to say, not substantially larger than the half width of an impeller of the priming stage.

7. A centrifugal pump according to any one of the claims 1 to 3, wherein the second port includes a first canal which discharges into a geodetically deep located area of the fully loaded pump stage.

8. A centrifugal pump according to claim 7 wherein, apart from said canal, the second port includes a bore which discharges into the fully loaded pump stage next to a rotor thereof closer to the axis than said canal.

* * * * *